US009289820B1

(12) United States Patent
Ludtka et al.

(10) Patent No.: US 9,289,820 B1
(45) Date of Patent: Mar. 22, 2016

(54) APPARATUS AND METHOD FOR DISPERSING PARTICLES IN A MOLTEN MATERIAL WITHOUT USING A MOLD

(71) Applicant: UT-Battelle, LLC, Oak Ridge, TN (US)

(72) Inventors: Gerard M. Ludtka, Oak Ridge, TN (US); John B. Wilgen, Oak Ridge, TN (US)

(73) Assignee: UT-Battelle, LLC, Oak Ridge, TN (US)

( * ) Notice: Subject to any disclaimer, the term of this patent is extended or adjusted under 35 U.S.C. 154(b) by 0 days.

(21) Appl. No.: 14/692,034

(22) Filed: Apr. 21, 2015

(51) Int. Cl.

| | |
|---|---|
| ***B22D 11/01*** | (2006.01) |
| ***B22D 11/108*** | (2006.01) |
| ***B22D 11/115*** | (2006.01) |
| ***B22D 11/124*** | (2006.01) |
| ***B22D 19/14*** | (2006.01) |
| ***B22D 25/00*** | (2006.01) |
| ***B22D 45/00*** | (2006.01) |

(52) U.S. Cl.
CPC ..... *B22D 11/015* (2013.01); *B22D 11/108* (2013.01); *B22D 11/124* (2013.01); *B22D 19/14* (2013.01); *B22D 25/00* (2013.01); *B22D 45/00* (2013.01)

(58) Field of Classification Search
CPC .... B22D 11/015; B22D 11/108; B22D 41/58; B22D 11/049; B22D 11/115
USPC ..... 164/97, 461, 467, 473, 503, 468
See application file for complete search history.

(56) References Cited

U.S. PATENT DOCUMENTS

| | | | | |
|---|---|---|---|---|
| 3,985,179 A | | 10/1976 | Goodrich et al. | |
| 4,289,946 A | | 9/1981 | Yarwood et al. | |
| 4,473,104 A | * | 9/1984 | Ungarean | B22D 11/181 164/155.4 |
| 4,523,625 A | * | 6/1985 | Ast | B22D 11/0611 164/461 |
| 4,530,404 A | | 7/1985 | Vives | |
| 4,741,383 A | * | 5/1988 | Hull | B22D 11/015 164/467 |

(Continued)

FOREIGN PATENT DOCUMENTS

| | | | |
|---|---|---|---|
| CN | 100392126 | C | 6/2008 |
| CN | 101391291 | A | 3/2009 |

(Continued)

OTHER PUBLICATIONS

Hao, et al., "Improvement of Casting Speed and Billet Quality of Direct Chill Cast Aluminum Wrought Alloy with Combination of Slit Mold and Electromagnetic Coil," *Materials Transactions*, 48, 8 (2007) pp. 2194-2201.

(Continued)

*Primary Examiner* — Kevin E Yoon
(74) *Attorney, Agent, or Firm* — Brinks Gilson & Lione

(57) ABSTRACT

An apparatus for dispersing particles within a molten material in a mold-less casting process comprises a primary electromagnet for generating an AC magnetic field and a secondary electromagnet adjacent to the primary electromagnet for generating an independent DC magnetic field. Each of the primary and secondary electromagnets comprises a coil and at least one of the electromagnets is positioned about a common longitudinal axis. A heat source may be positioned at a first end of the common longitudinal axis for forming a melt to be exposed to the AC and DC magnetic fields, and a particle injection device is positioned at one or more positions about the common longitudinal axis for injecting particles into the melt during magnetic field exposure. The apparatus does not include a solid body for containing the melt prior to solidification.

13 Claims, 8 Drawing Sheets

(56) References Cited

U.S. PATENT DOCUMENTS

| | | | | |
|---|---|---|---|---|
| 4,846,255 | A | 7/1989 | Hull | |
| 5,014,769 | A * | 5/1991 | El-Kaddah | H05B 6/22 164/493 |
| 6,402,367 | B1 * | 6/2002 | Lu | B01F 13/0006 164/504 |
| 7,161,124 | B2 | 1/2007 | Kisner et al. | |
| 7,534,980 | B2 | 5/2009 | Wilgen et al. | |
| 7,745,765 | B2 | 6/2010 | Kisner et al. | |
| 2012/0060648 | A1 | 3/2012 | Zhao et al. | |
| 2012/0227924 | A1 * | 9/2012 | Miki | B22D 11/115 164/468 |
| 2014/0299288 | A1 * | 10/2014 | Eriksson | B22D 11/16 164/452 |

FOREIGN PATENT DOCUMENTS

| | | | |
|---|---|---|---|
| CN | 102121075 | A | 7/2011 |
| CN | 101787503 | B | 9/2012 |
| CN | 103484706 | A | 1/2014 |
| JP | 4661548 | B2 | 3/2011 |

OTHER PUBLICATIONS

Ludtka, et al., "In Situ Evidence of Enhanced Transformation Kinetics in a Medium Carbon Steel Due to a High Magnetic Field," *Scripta Materialia*, 51 (2004) pp. 171-174.

Ludtka, Gerald (Gerry) M., "Final Technical Report: Magnetic Field Processing—A Heat Free Heat Treating Method," Oak Ridge National Laboratory, Oak Ridge, TN (Aug. 8, 2012) pp. 1-73, available from U.S. Department of Energy Information Bridge: www.osti.gov/bridge.

Rolling Aluminum: From the Mine Through the Mill, *The Aluminum Association, Inc.* (2008) pp. 1-135.

Seidel, et al., "EML—An Electromagnetic Levitator for the International Space Station," *Journal of Physics: Conference Series*, 327 (2011) pp. 012057-1-012057-14.

* cited by examiner

APPARATUS AND METHOD FOR DISPERSING PARTICLES IN A MOLTEN MATERIAL WITHOUT USING A MOLD

TECHNICAL FIELD

The present disclosure is related generally to molten material processing and more particularly to electromagnetic casting technology.

BACKGROUND

Electromagnetic acoustic transducer (EMAT) technology has been applied to molten metals to achieve non-contact heating and/or mixing of the melt. As described for example in U.S. Pat. No. 7,534,980, a molten metal may be contained in a mold or crucible and exposed to time-varying and static magnetic fields to induce a large oscillatory electromagnetic force, or pressure, on the sample. The induced acoustic driving force is bi-directional, alternately compressing and stretching the sample, promoting mixing, cavitation and heating of the melt. However, at high static magnetic fields, the amplitude of the oscillations may be so high that excessive heating and stressing of the sample occurs, leading to contamination of the melt with the mold material and/or fracturing of the mold during EMAT processing. Alternately, mold-melt interactions can be a direct result of basic thermodynamics leading to reaction and potential undesirable dissolution of elemental constituents from the mold and subsequent solution or precipitation of those in the melt, causing unexpected or unwanted chemistry changes. Another mechanism is the forceful erosion of the mold material aided by the EMAT excitation-produced melt cavitation process and subsequent bubble collapsing, which may ablate mold material into the melt. It would be advantageous to develop a method of molten material processing that allowed heating and non-contact mixing to occur without risk of contamination from a mold, or other problems.

BRIEF SUMMARY

An apparatus and a method for dispersing particles within a molten material in a mold-less casting process have been developed.

The apparatus comprises a primary electromagnet for generating an AC magnetic field and a secondary electromagnet adjacent to the primary electromagnet for generating an independent DC magnetic field. Each of the primary and secondary electromagnets comprises a coil and at least one of the electromagnets may be positioned about a common longitudinal axis. A heat source may be positioned at a first end of the common longitudinal axis for forming a melt to be exposed to the AC and DC magnetic fields, and a particle injection device is positioned at one or more positions about the common longitudinal axis for injecting particles into the melt during magnetic field exposure. The apparatus does not include a solid body for containing the melt prior to solidification, as the AC magnetic field generated by the primary electromagnet is configured to supply a gradient electromagnetic pressure to contain the melt.

The method comprises, according to one embodiment, forming a molten mass of material unsupported by a mold or other solid body, and applying a gradient electromagnetic pressure and an oscillatory electromagnetic pressure to the molten mass. The gradient electromagnetic pressure is non-oscillatory and is varied over at least a portion of the molten mass. Particles are injected into a surface region of the molten mass as the gradient and oscillatory electromagnetic pressures are applied. The gradient electromagnetic pressure constrains the molten mass of material to a predetermined shape, while the oscillatory electromagnetic pressure promotes mixing of the particles in the surface region. After injecting and mixing the particles, the molten mass of material is solidified, thereby forming a particle-reinforced casting with enhanced surface properties and/or improved bulk properties.

The method comprises, according to another embodiment, forming a molten mass of material unsupported by a mold or other solid body, where the molten mass of material includes a plurality of particles dispersed therein. A gradient electromagnetic pressure and an oscillatory electromagnetic pressure are applied to the molten mass of material. The gradient electromagnetic pressure is non-oscillatory and is varied over at least a portion of the molten mass, thereby constraining the molten mass of material to a predetermined shape, while the oscillatory electromagnetic pressure promotes mixing of the particles in the molten column. The molten mass of material is then solidified, thereby forming a particle-reinforced casting with enhanced surface and/or bulk properties.

DETAILED DESCRIPTION

The apparatus and method described herein allows electromagnetic acoustic transducer (EMAT) processing to be applied to a mold-less continuous or batch casting process without any contact between the melt and a solid surface during solidification. Instead, the molten material may be supported by the energy density, or pressure, of an applied AC magnetic field. Without a mold, the surface of the molten material may be directly accessed during casting to produce uniform or gradient dispersion composites with enhanced surface properties.

Figure 1:
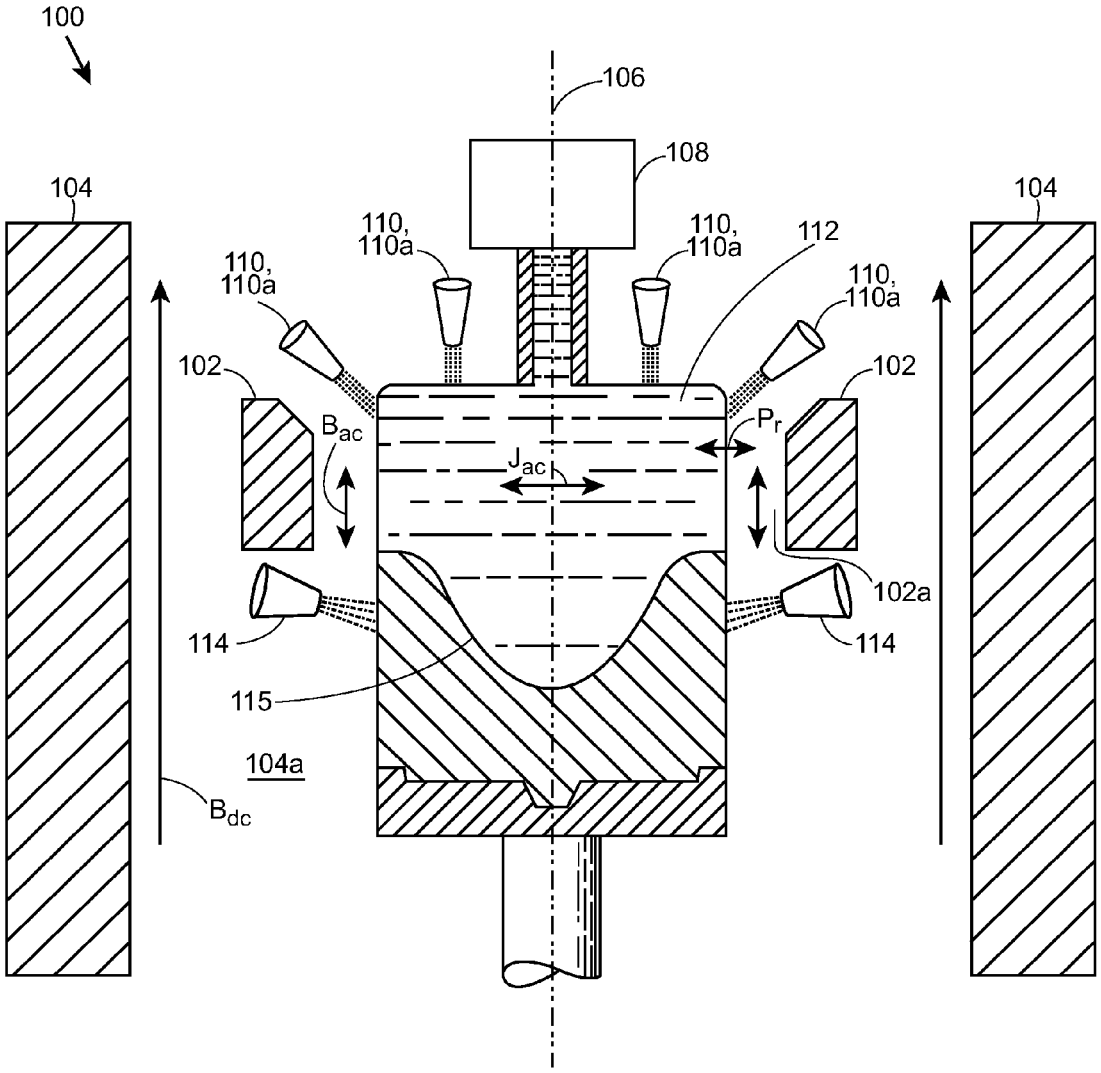
FIG. 1 shows a schematic of an exemplary apparatus for dispersing particles within a molten material in a continuous or batch casting process.

A cross-sectional schematic of an exemplary apparatus for dispersing particles within a molten material in a continuous or batch casting process is illustrated in FIG. 1. The apparatus 100 includes a primary electromagnet 102 for generating an AC magnetic field and a secondary electromagnet 104 positioned adjacent to the primary electromagnet 102 for generating an independent DC magnetic field. Each of the primary and secondary electromagnets 102,104 comprises an axially-wound conductive or superconductive coil that defines a central bore 102*a*,104*a*. The electromagnets 102,104 may be concentrically positioned about a common longitudinal axis 106. Typically, as shown in FIG. 1, the common longitudinal axis 106, which may be referred to as a z-axis, coincides with the vertical direction, as defined by the force of gravity.

Also as shown in FIG. 1, the primary electromagnet 102 is positioned inside the secondary electromagnet 104. The central bore 104*a* of the secondary electromagnet 104 has a diameter large enough to accommodate the primary electromagnet 102 therein. A magnet or other device that is described as positioned "inside" a given electromagnet may be understood to be positioned partially or fully within the central bore of the given electromagnet, and a magnet or other device that is described as positioned "outside" a given electromagnet may be understood to be positioned fully outside the central bore of the given electromagnet.

It is contemplated that other configurations of the electromagnets 102,104 may be possible, such as positioning the secondary electromagnet 104 inside the primary electromagnet 102, assuming different magnet sizes than shown in FIG. 1. Also, it should be noted that the axially-would coil that makes up each electromagnet 102,104 may have a circular cross-section or another axisymmetric configuration (e.g., oval, elliptical, etc.).

The apparatus 100 may comprise a heat source 108 for forming a melt to be processed by the AC and DC magnetic fields generated by the primary and secondary electromagnets 102,104. In some cases, the heat source 108 may be positioned at a first end of the common longitudinal axis 106 (e.g., where material to be melted is introduced). More specifically, the heat source 108 may be positioned outside one or both of the primary and secondary electromagnets 102,104. Alternatively, the heat source 108 may be positioned inside one or both of the primary and secondary electromagnets 102,104. It is also possible that the heat source may be positioned at a remote location away from the apparatus 100, and the material to be processed by the electromagnets 102,104 may be transferred to the apparatus while in the molten state.

The heat source 108 may partially or fully surround a batch sample or a continuous feed of solid material and may melt at least a portion of the solid material for processing by the primary and secondary electromagnets 102,104. The heat source 108 may comprise an induction coil wound about the common longitudinal axis 106. Also or alternatively, the heat source 108 may comprise one or more resistance heating elements, a microwave source and/or another heating mechanism known in the art. Referring for example to FIG. 1, the heat source 108 may be positioned outside the primary electromagnet 102 but inside the secondary electromagnet 104. In a configuration where the common longitudinal axis 106 is aligned with the vertical direction, as shown for example in FIG. 1, the heat source 108 may be described as being above the primary electromagnet 102.

In a mold-less casting process, the melt formed by the heat source 108 takes the form of a molten mass 112 of material constrained to a predetermined geometry (e.g., a column) within the central bore 102*a* of the primary electromagnet 102, as shown in FIG. 1. The terms "melt," "molten mass of material," "molten material" and the like may be used interchangeably and may be understood to refer to a flowable material that is above its melting temperature or glass transition temperature, or in a semi-solid state. The molten mass 112 of material is supported by the electromagnetic pressure applied by the AC magnetic field of the primary electromagnet 102, as explained further below. Since the casting process is mold-less, the apparatus 100,200 does not include a solid body (e.g., mold, die or other solid support) for containing the melt during exposure to the magnetic fields. The material may be inherently electrically conductive or may contain additives to render it electrically conductive, as described further below, to be responsive to the magnetic fields.

A particle injection device 110 may be positioned at one or more positions about the common longitudinal axis 106 for injecting particles into the melt 112. The particle injection device 110 may be disposed inside or outside one or both of the primary and secondary electromagnets 102,104.

In one example, the particle injection device 110 may take the form of one or more nozzles 110*a* positioned about the common longitudinal axis 106 and oriented toward the molten mass of material, as shown for example in FIG. 1. Such nozzles may be, for example, conventional spray nozzles that are commercially available for thermal or plasma spraying applications. Up to 20 spray nozzles (e.g., at least 2, at least 4, at least 6, or at least 10 spray nozzles) may be arranged about the common longitudinal axis for injection of the particles into the molten material. Alternatively, the particle injection device 110 may comprise a ring with multiple outlet holes (e.g., from 2 to 100 holes) along the underside and/or the inside that allow particles to be emitted towards the molten mass.

The particle injection device 110 may be positioned inside the secondary electromagnet 104 just above or adjacent to the primary electromagnet 102. In both of these cases, the particles are injected into the molten mass while being exposed to the DC magnetic field of the secondary electromagnet 102,104.

Alternatively, it may be advantageous for the particle injection device 110 to be positioned outside the secondary electromagnet 104 that generates the high magnetic field (e.g., in a case where the particles are ferromagnetic). For this configuration, the primary electromagnet 102 may be designed to extend along the z-axis through and beyond the central bore 104*a* of the secondary electromagnet 104, such that one or both ends of the primary electromagnet 102 are outside the high field region. Particles generated outside the high field region may be accelerated in the direction of the molten mass 112 of material when emitted from the particle injection device 110.

The particles may be injected at an appropriate mass per time per unit surface area impinged by the molten mass to give the desired mass fraction of particles desired in the final solidified product, as would be recognized by one of ordinary skill in the art. The final mass of particles in the desired product may depend on whether a gradient chemistry (surface to center of molten mass) or a uniform dispersion of particles throughout the solidified product is desired. The resultant gradient chemistry or uniform chemistry may depend on the EMAT processing parameters and duration before final solidification of the molten stream.

Referring again to FIG. 1, the apparatus 100 may also include a cooling mechanism 114 positioned at a second end of the common longitudinal axis 106, where the melt 112 is solidified into a particle-reinforced casting 116. An interface 115 between the molten mass 112 and the particle-reinforced casting 116 is shown schematically in FIG. 1. The cooling mechanism 114 may be positioned outside one or both of the primary and secondary electromagnets 102,104, as shown in FIG. 1. In a configuration where the common longitudinal axis 106 is aligned with the vertical direction, the cooling mechanism 114 may be described as being below one or both of the primary and secondary electromagnets 102,104.

The cooling mechanism 114 may comprise gas jets directed toward the molten mass, for example, or a gas flow, preferably of a thermally conductive inert gas. Suitable gases include helium, argon, hydrogen and/or nitrogen, although other gases may also or alternatively be used. Helium has a thermal conductivity at 400 K of 191 mW/m·K; hydrogen has a thermal conductivity of 230 mW/m·K. Nitrogen and argon have lower thermal conductivities (32 mW/m·K and 23 mW/m·K, respectively). Mixing small quantities of hydrogen in with nitrogen or argon can yield gases with higher thermal conductivities. Depending on the size of the molten mass of material, the flow of gas may be adjusted to higher or lower flow rates to achieve a desired cooling rate. In addition, the cooling mechanism can involve liquid media such as water, water-polymer mixtures, or oil quenching solutions. The cooling fluid (liquid or gas) may provide a specific cooling rate depending on the delivery rate to the mass surface as well as the thermal conductivity, and this may in turn help to achieve the desired microstructure in the final product.

Several exemplary embodiments of the apparatus and method for dispersing particles in a molten material are described now in reference to FIGS. 2-5B.

Figure 2:
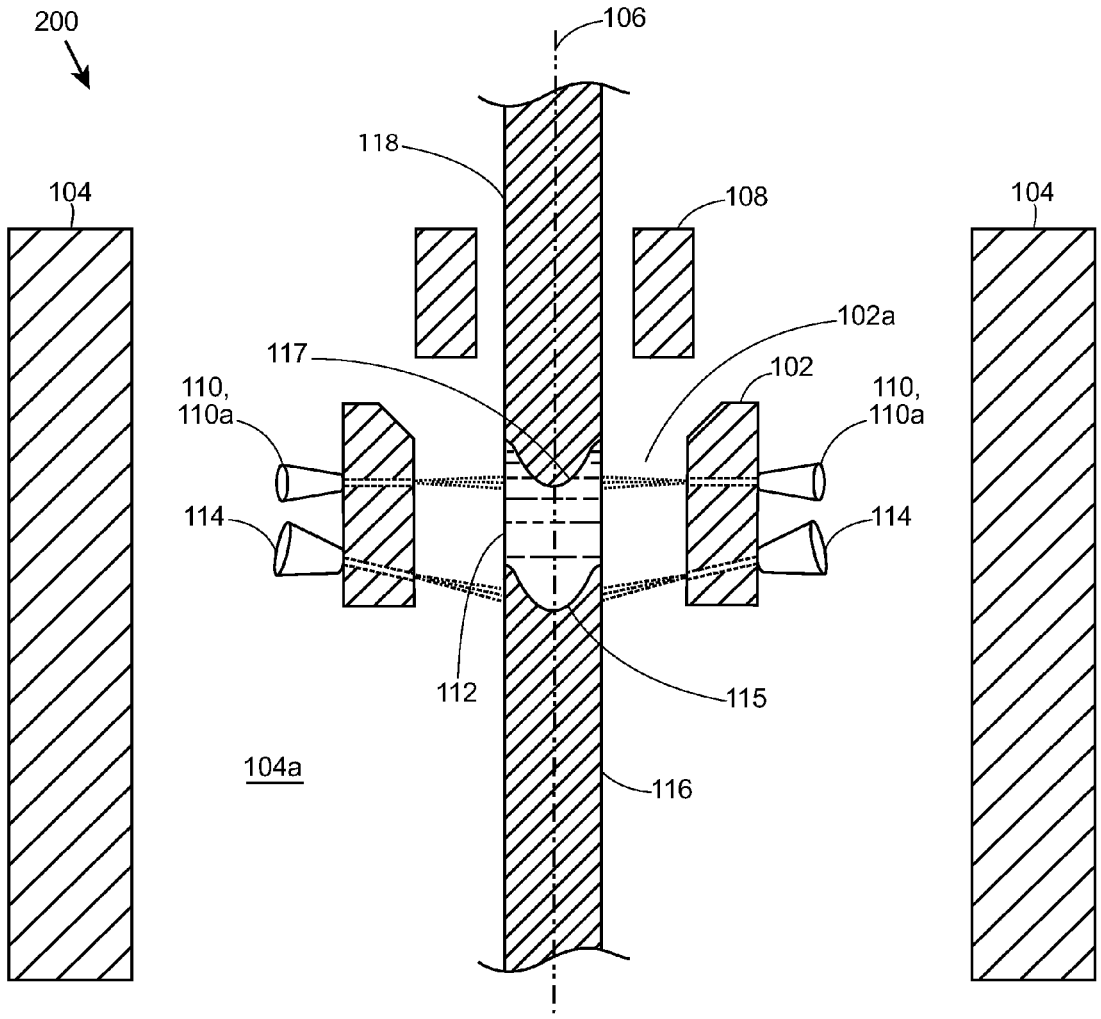
FIG. 2 shows a schematic of an exemplary apparatus for dispersing particles within a molten material in a continuous casting process, according to one embodiment.
Figure 3:
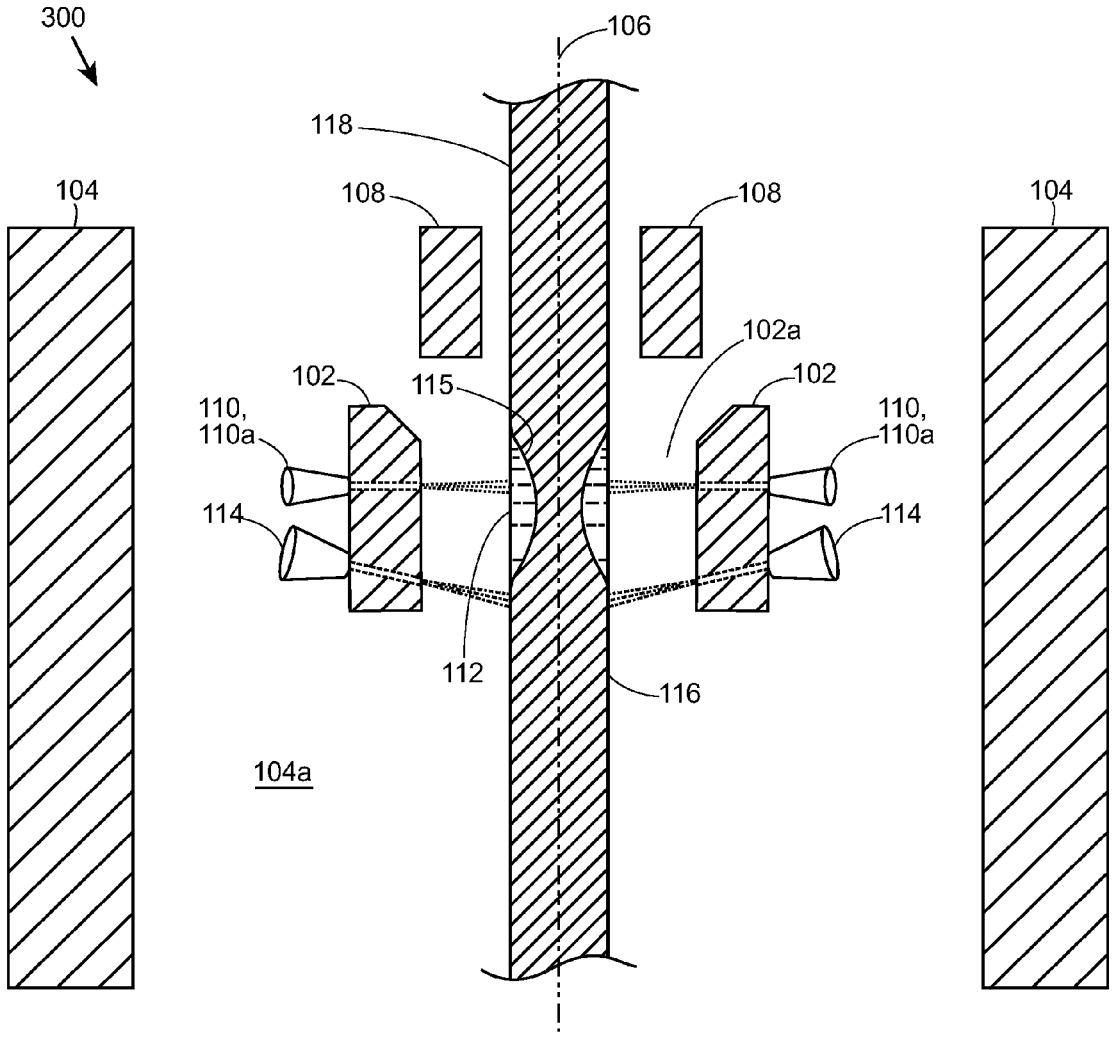
FIG. 3 shows a schematic of an exemplary apparatus for dispersing particles within a molten material in a continuous casting process, according to another embodiment.

FIGS. 2 and 3 illustrate a mold-less casting process in which a continuous feed of solid material is processed. In these examples, the magnetic processing apparatus 200,300 comprises a heat source 108 that partly or fully surrounds a continuous feed 118 of solid material. The heat source 108 is configured to melt at least a portion of the solid material for processing by the primary and secondary electromagnets 102,104. The portion of the continuous feed 118 of solid material that is melted (thus forming the melt 112) may extend entirely through the thickness of the continuous feed 118, as shown in FIG. 2, or only partway through the thickness of the continuous feed 118, as shown in FIG. 3. In the latter case, the portion may be a surface portion of the continuous feed 118. The transfer of the continuous feed 118 of solid material into the apparatus 200,300 for magnetic processing may be controlled to occur at the same rate as removal of the particle-reinforced casting 116 from the apparatus 200, 300.

A plurality of nozzles 110*a* may be employed as the particle injection device 110, as shown in FIGS. 2 and 3. The nozzles 110*a* are positioned at multiple positions about the common longitudinal axis 106 for injecting particles into the melt 112. In these examples, the nozzles 110*a* are disposed inside the secondary electromagnet 104 and adjacent to the primary electromagnet 102. More specifically, the nozzles 110*a* are positioned between the primary and secondary electromagnets 102,104 such that particles may be injected into the melt 112 after passing through the coil of the primary electromagnet 102. The cooling mechanism 114 is also positioned between the primary and second electromagnets 102, 104, such that, during magnetic processing, a cooling fluid may be injected through the coil of the primary electromagnet 102 and onto the surface of the melt 113. Upon exposure to the cooling fluid, the melt 112 solidifies into the cast composite 116.

Figure 4A:
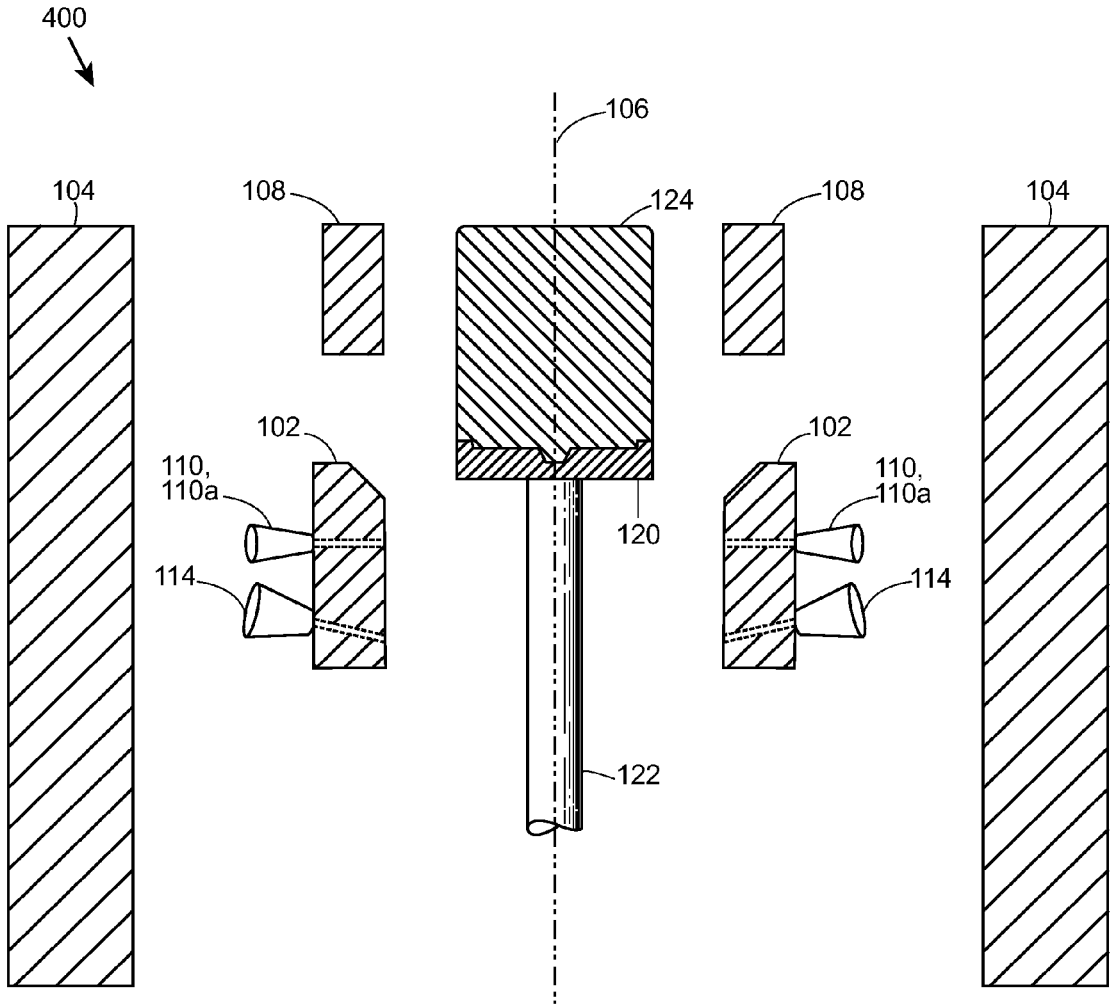
FIGS. 4A-4C show several views of an exemplary apparatus for dispersing particles within a molten material in a batch casting process, according to one embodiment.
Figure 4B:
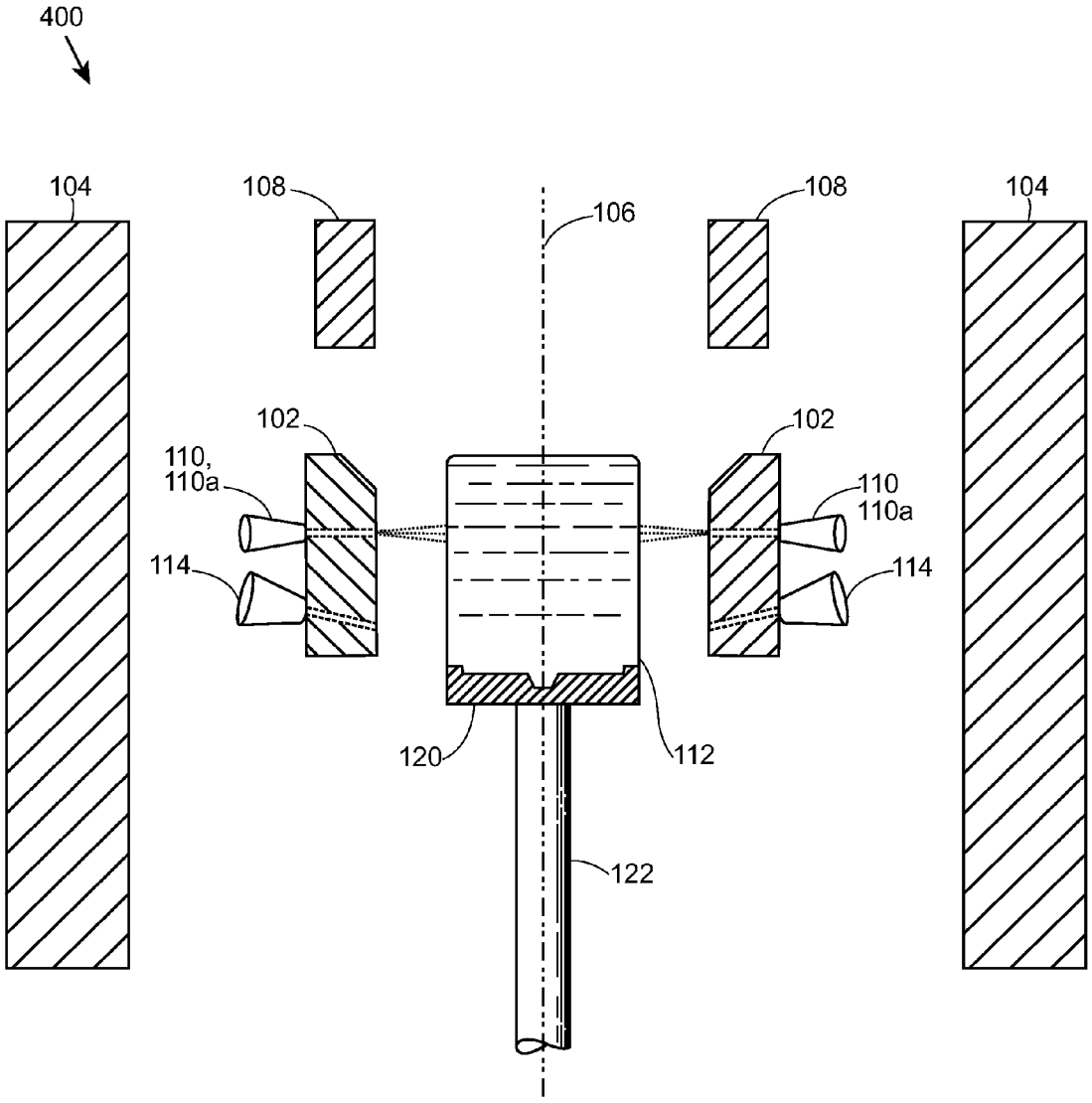
Figure 4C:
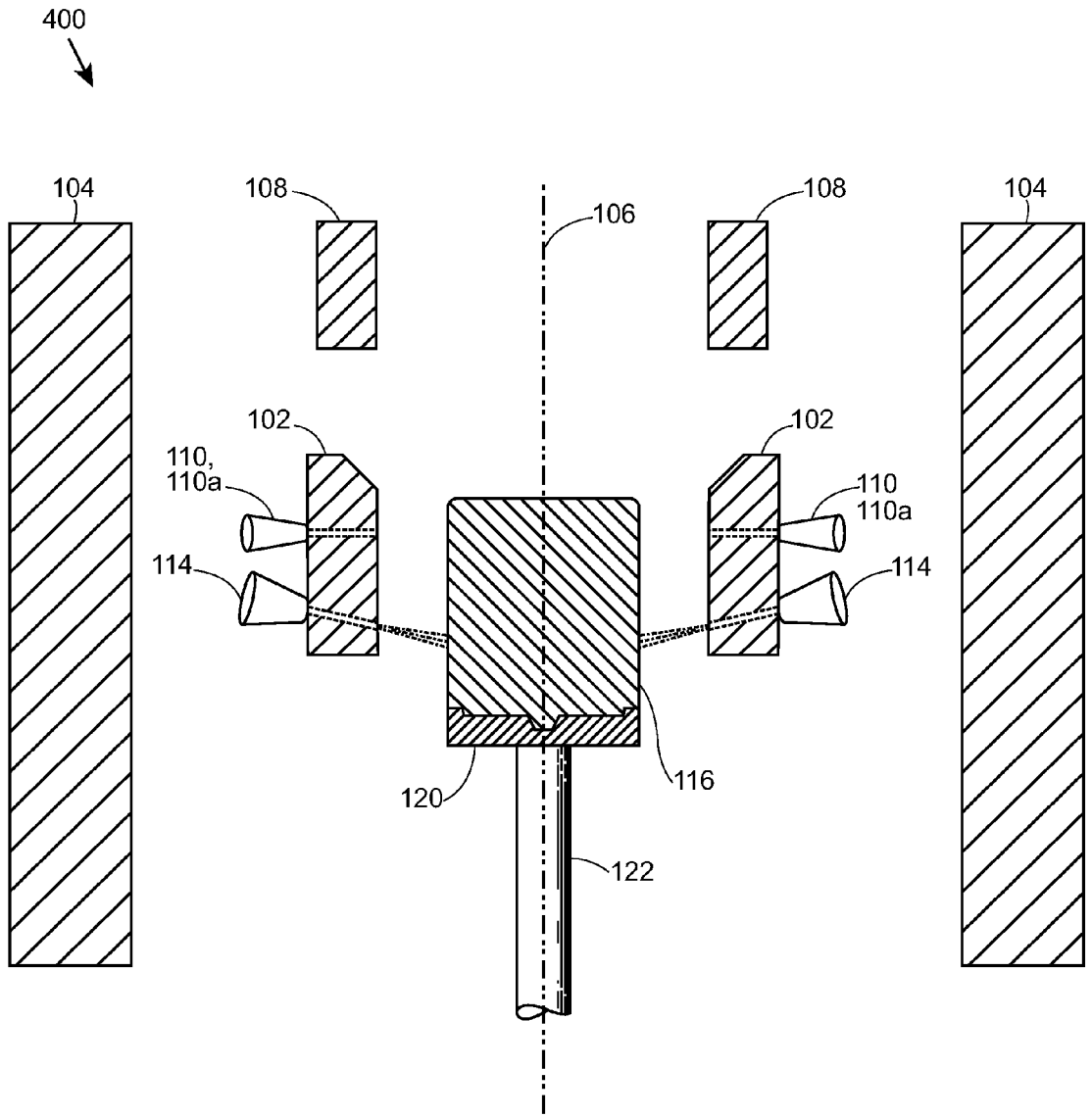

FIGS. 4A-4C show several views of another exemplary apparatus 400 designed for a batch casting process in which particles are dispersed in a molten material. A batch 124 of solid material is supported by a platform 120 attached to a translatable rod 122 aligned with the common longitudinal axis 106. In FIG. 4A, the translatable rod 122 is positioned such that the batch 124 of material is adjacent to a heat source 108. The heat source 108 is configured to preheat the batch 124 of solid material to a temperature just below the melting temperature prior to processing by the primary and secondary electromagnets 102,104. In the example shown in FIGS. 4A-4B, the primary electromagnet 102 is used not only for containment of the melt 112, but also for heating the batch 124 of solid material to the melting temperature. In such a case, the AC current may be increased to facilitate heating to the melting temperature in a shorter time frame.

FIG. 4B shows the molten mass 112 of material after the translatable rod 122 has been moved along the longitudinal axis 106 to position the batch 124 of solid material inside the primary and secondary electromagnets 102,104 for exposure to the AC and DC magnetic fields. Once a melt 112 is formed, particles may be injected into the surface of the melt 112 by way of the nozzles 110*a* positioned between the primary and secondary electromagnets 102,104, as described above in reference to FIGS. 2 and 3. Also as above, a cooling mechanism 114 may be positioned between the primary and second electromagnets 102,104, such that, during magnetic processing, a cooling fluid may be injected through the coil of the primary electromagnet 102 and onto the surface of the melt 112, allowing for solidification into the particle-reinforced composite 116.

Figure 5A:
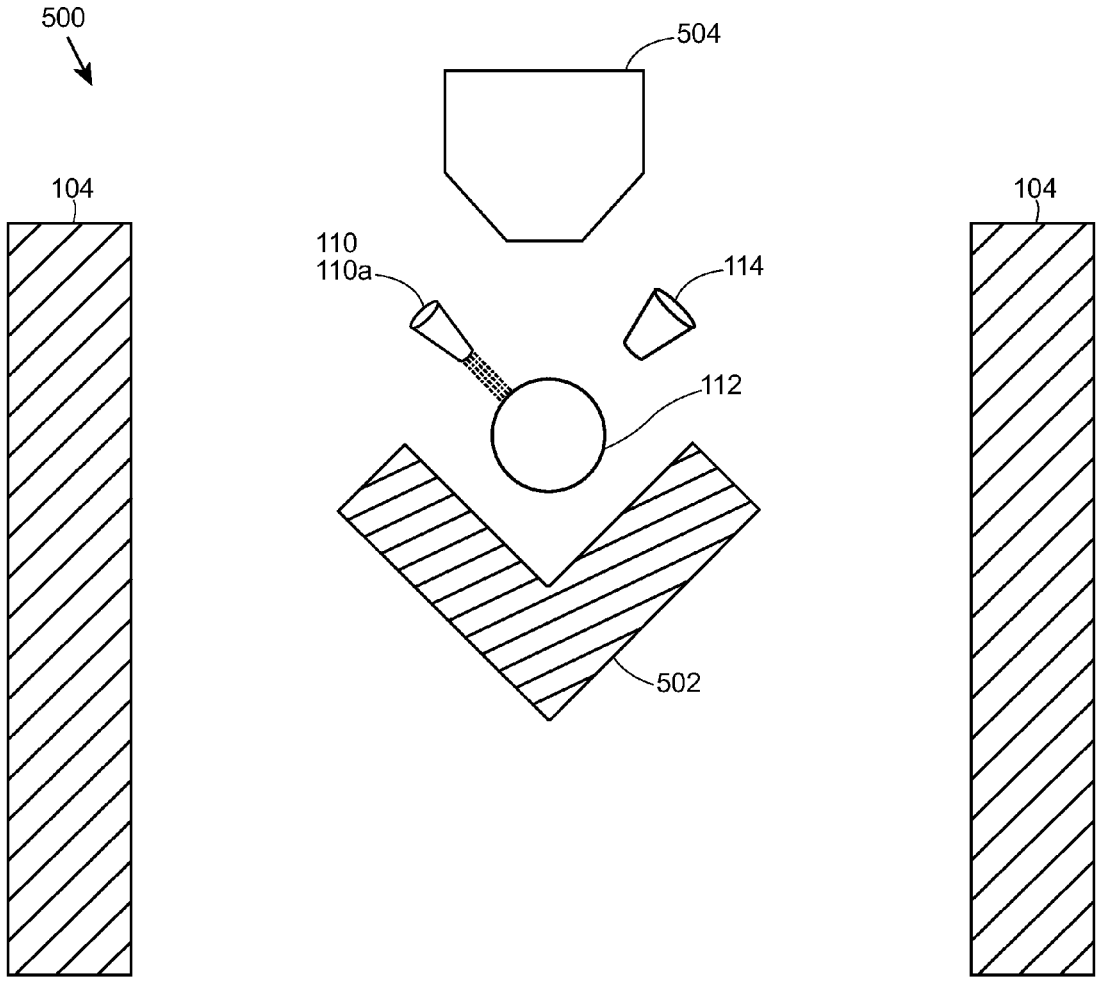
FIGS. 5A and 5B show two views of an exemplary apparatus in which the primary electromagnet is configured to supply an AC magnetic field that imparts a vertical component to the electromagnetic pressure used to levitate the molten material.
Figure 5B:
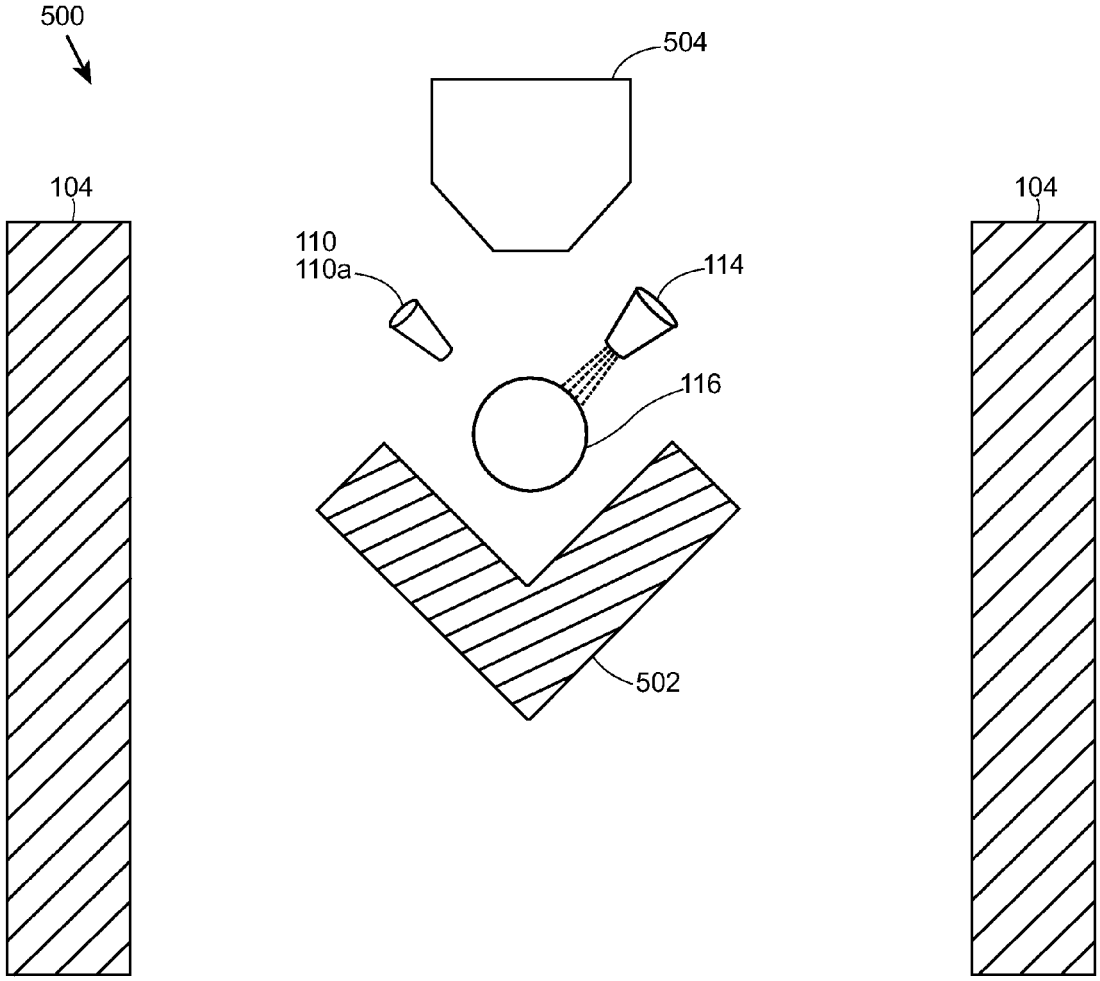

FIGS. 5A and 5B show two views of an apparatus 500 in which the primary electromagnet 502 is configured to supply an AC magnetic field that imparts a vertical component to the electromagnetic pressure used to levitate the molten mass 112 during particle injection and/or mixing. Because the electromagnetic pressure is vertically directed in addition to radially directed as in the previous embodiments (as shown for example by the arrow labeled $P_r$ in FIG. 1), the molten mass 112 may be levitated above the primary electromagnet 502. Prior to magnetic processing, a batch of solid material may be inserted to a position within the primary and secondary electromagnets and heated to a temperature at or above the melting temperature by heat source 504, thereby forming the molten mass 112. Particle injection may be achieved using one or more nozzles 110*a*, as illustrated in FIG. 5A and described above. After injection and mixing of the particles in the molten mass 112, cooling may be effected using a cooling mechanism 114 to direct a cooling fluid onto the molten mass 112, as shown in FIG. 5B and described previously.

The apparatus described above according to several embodiments allows EMAT processing to be applied to a mold-less continuous or batch casting process without any contact between the melt and a solid surface during solidification. Instead, the molten material may be supported by the electromagnetic pressure of the AC magnetic field during solidification. The interaction of a time varying magnetic field with the surface of the liquid metal results in an induced AC eddy current at the surface of the melt. The Lorentz force due to the interaction of the eddy current with the applied AC magnetic field results in a pressure gradient that matches the pressure gradient of the excluded AC magnetic field. For the exemplary configurations described herein, the AC magnetic field may be confined to the relatively narrow gap between the primary electromagnet (AC magnetic field coil) and the surface of the liquid metal mass, and can be tailored to support the pressure of the mass during solidification.

The approach described herein allows large amplitude vibrations to be introduced at the surface of a magnetically supported melt for the purpose of improving the properties of the cast material and/or to create opportunities for additional processing steps that are not otherwise possible during the solidification process. For example, large amplitude vibration in the acoustic frequency range may be used to accelerate the dispersion of particles that are introduced at the surface of the molten material prior to solidification. The result may be a gradient chemistry near the surface and/or uniformly dispersed particles throughout the bulk of the cast product, depending on the EMAT duration and processing speeds.

Accordingly, the present method of forming a uniform or gradient composite structure entails forming a molten mass of material unsupported by a mold or other solid body. The molten mass of material may or may not contain particles at this point in the process. A gradient electromagnetic pressure and an oscillatory electromagnetic pressure are applied to the molten mass. The term "gradient electromagnetic pressure" is used in reference to the time-averaged component of the electromagnetic pressure, which is non-oscillatory and which supports the molten mass, as discussed further below. The gradient electromagnetic pressure is varied over at least a portion of the molten mass in order to constrain the molten mass of material to a predetermined shape while the oscillatory electromagnetic pressure promotes mixing. Ultimately, the molten mass of material 112 is solidified to form a particle-reinforced casting 116, such as a metal matrix composite or a polymer matrix composite, which may exhibit improved surface and/or bulk properties.

Particles may be injected into a surface region of the molten mass 112 as the gradient and oscillatory electromagnetic pressures are being applied. The gradient electromagnetic pressure constrains the molten mass 112, and the oscillatory electromagnetic pressure promotes dispersion of the particles in the surface region. Mixing may also occur throughout the entire cross-section of the molten mass. As indicated above, the molten mass of material 112 may contain some amount of particles ("pre-existing particles") prior to electromagnetic casting. The pre-existing particles may be the same as or different than the particles injected ("injected particles") into the molten mass of material during processing. The resulting composite material may comprise a uniform or a non-uniform dispersion of the particles, where "particles" may be understood to refer to the injected particles in addition to any pre-existing particles, or to just the pre-existing particles if additional particles are not injected during processing. In one example, there may be a higher concentration of particles at the surface region of the molten mass 112 of material (and ultimately in the solidified composite 116) than in the bulk, due to the particle injection. In another example, particles contained in the molten mass 112 of material prior to exposure to the electromagnetic pressures may be more uniformly dispersed in the molten mass 112 during processing, leading to an extremely homogeneous cast composite 116 with improved properties.

The gradient electromagnetic pressure used to support the molten mass may be varied as a function of z over part or all of the length of the molten mass, particularly when the z-direction coincides with the vertical direction. The variation in the gradient electromagnetic pressure may not be limited to the z-direction, however. For example, the variation may extend about all or a portion of the circumference or perimeter of the molten mass, particularly when the z-direction is not aligned with the vertical direction. The gradient electromagnetic pressure may be varied continuously, such as linearly.

A nonuniform coil spacing may be used to achieve the desired variation of the gradient electromagnetic pressure. For example, the coil windings of the primary electromagnet may be closer together or more dense along one or more portions of the length of the molten mass and further apart or less dense along other portion(s) of the length of the molten mass. In places where the number of turns per unit length varies, magnetic field gradients may occur and the strength of the radial force and thus the electromagnetic pressure may vary as a function of z. The spacing of the windings in the primary electromagnet and/or in the secondary electromagnet may be chosen so as to vary the magnitude of radial force at different positions along the z axis and thus produce the desired electromagnetic pressure gradient. The coil windings of the secondary electromagnet may also be varied as described above. Alternatively, one or both of the primary and secondary electromagnets may have a uniform coil spacing.

Applying the gradient and oscillatory electromagnetic pressures to the molten mass of material may entail exposing the molten mass to an AC magnetic field and to an independent DC magnetic field. The DC magnetic field may comprise a field strength of at least about 1 Tesla, at least about 2 Tesla, at least about 3 Tesla, at least about 4 Tesla, at least about 5 Tesla, at least about 6 Tesla, at least about 7 Tesla, at least about 8 Tesla, at least about 9 Tesla, at least about 10 Tesla, at least about 15 Tesla, or at least about 20 Tesla. The field strength of the DC magnetic field is typically no higher than about 50 Tesla, or no higher than about 30 Tesla. For example, the field strength of the DC magnetic field may be from about 1 Tesla to about 30 Tesla, or from about 5 Tesla to about 20 Tesla. The AC magnetic field may comprise a field strength of from about 0.01 to about 0.5 Tesla and a sonic or ultrasonic frequency of from about 0.05 kHz to about 10,000 kHz.

The molten mass of material may take the form of a cylinder, rectangular slab or other shape having a longitudinal axis oriented along the z-direction, which may coincide with the vertical direction as defined by the force of gravity. In some embodiments, the molten mass of material may be a sphere. As described in greater detail below, for a cylindrical melt, the gradient electromagnetic pressure applied to the molten mass may be expressed mathematically as $[B_{ac}(z)]^2/2\mu$, where $\mu$ is the permeability in free space and $B_{ac}(z)$ is field strength of the AC magnetic field, and the oscillatory electromagnetic pressure applied to the molten mass may be expressed mathematically as $B_{dc}(B_{ac}(z)/\mu)\sin(\omega t)+([B_{ac}(z)]^2/2\mu)\cos(2\ \omega t)$, where $\mu$ is permeability in free space, $B_{ac}(z)$ is field strength of the AC magnetic field, $B_{dc}(z)$ is field strength of the DC magnetic field, t is time, and $w=2\pi f$, where f is frequency of the AC magnetic field.

As set forth above in reference to the exemplary apparatus shown in FIG. 1, a primary electromagnet 102 may be employed to generate the AC magnetic field and a secondary electromagnet 104 positioned adjacent to the primary electromagnet 102 may be employed to produce the independent DC magnetic field. Each of the primary and secondary electromagnets 102,104 comprises a central bore 102*a*,104*a* defined by an axially-wound conductive or superconductive coil, and may have other characteristics as set forth elsewhere in this disclosure.

FIGS. 1 and 2 illustrate embodiments in which the DC magnetic field is produced by a dedicated coil (the secondary electromagnet) that is separate from the AC magnetic field coil (the primary electromagnet). The primary electromagnet and/or the secondary electromagnet may comprise a water-cooled copper coil or a superconducting coil. Use of a superconducting electromagnet greatly reduces the power requirements and greatly expands the range of magnetic field values that are practical. If only modest values of DC field are required, then it might be feasible to use a single electromagnet to provide both the AC and DC magnetic fields. In this case, a power supply capable of providing a DC current in addition to an AC current, with both being independently variable, may be required. If the same electromagnet is used to create the supporting AC magnetic field and the static DC magnetic field, then these may be automatically aligned, but at the expense of flexibility in altering the configuration (e.g., shifting the DC field region and shape with respect to the AC field location).

To form the molten mass of material, at least a portion of a continuous feed of solid material may be melted in a continuous casting process. Alternatively, in a batch casting process, at least a portion of a batch sample of solid material may be melted to form the molten mass of material. As set forth above, a heat source such as an induction coil may partially or completely surround the batch sample or the continuous feed of solid material and may melt at least a portion of the solid material prior to processing by the AC and DC magnetic fields.

In order to support the hydrostatic pressure of the molten mass during the process and prior to solidification, the primary electromagnet which generates the AC magnetic field may be designed to produce a gradient electromagnetic pressure that matches the hydrostatic pressure of the liquid metal mass over the entire extent of the melt zone. The hydrostatic pressure may be lowest at the top of the molten mass and may increase linearly with depth when the molten mass is vertically oriented. The gradient electromagnetic pressure can be tailored to balance the hydrostatic pressure of the liquid mass as a function of height within the melt zone. As described above, the needed gradient may be achieved using a varied coil spacing of the primary electromagnet. Another approach is described in U.S. Pat. No. 3,985,179, entitled "Electromagnetic Casting Apparatus," which is hereby incorporated by reference in its entirety.

For an AC magnetic field and the associated AC eddy current induced on the surface of the melt, the electromagnetic pressure resulting from the Lorentz interaction includes a time dependent oscillatory pressure, the time average of which supports the pressure of the liquid metal mass. Note that for the purposes of the following discussion a cylindrical geometry is assumed, with the axis of the cylindrically shaped liquid metal column (as well as the directions of both the AC and DC magnetic fields) aligned parallel to the z-axis.

The vertically directed AC magnetic field may be represented by $B_z=B_o(z)\sin(\omega t)$, where $\omega=2\pi f$ and f is the frequency. The resulting azimuthally-directed eddy current induced in the surface of the liquid metal column is given by $J_\theta(z)=(B_o(z)/\mu)\sin(\omega t)$, where p is the permeability of free space (in MKS units), and the surface current density, $J_\theta(z)$, has units of A/m. In this case, the time-dependent radially-directed pressure is given by $P_r(z)=J_\theta(z)\times B_z=-([B_o(z)]^2/\mu)\sin^2(\omega t)$. Note that the pressure is unidirectional (directed radially inward into the surface of the liquid metal column) and does not reverse direction. Since $2\sin^2 x=1-\cos(2\times)$, this can be rewritten as $P_r=-([B_o(z)]^2/2\mu)+([B_o(z)]^2/2\mu)\cos(2\omega t)$. Therefore the electromagnetic pressure can be represented as a time-averaged inwardly-directed static pressure, given by $-[B_o(z)]^2/2\mu)$, and an oscillatory component of the same amplitude that oscillates at twice the frequency of the applied AC magnetic field. The first term is a mathematical representation of the gradient electromagnetic pressure, which, as discussed above, is non-oscillatory.

One of the features of electromagnetic casting is that the AC magnetic field inherently results in an incidental acoustic pressure oscillation at twice the frequency of the applied magnetic field, which can be very beneficial to the casting process. However, the amplitude of the resulting acoustic pressure is constrained by the fact that the static pressure gradient of the AC magnetic field is tailored to properly support the liquid metal column and therefore cannot be varied in amplitude. For example, to support a liquid aluminum column having a height of 0.15 m (6") a magnetic pressure of 0.04 bar may be needed, which in turn requires an AC magnetic field of 0.10 Tesla. In this case, the amplitude of the incidental acoustic pressure is limited to 0.04 bar (4 kPa), which may not be adequate to meet the requirements of the applications addressed by the present method.

Therefore, to provide independent control of the amplitude of the desired acoustic pressure oscillations, an additional static DC magnetic field is incorporated into the process. Referring again to FIG. 1, if the entire electromagnetic casting apparatus is placed in a vertically-directed static DC magnetic field, the resulting Lorentz J×B interaction of the current in the AC magnetic field generated by the primary electromagnet 102 with the static DC magnetic field of the secondary electromagnet 104 results in a radially-directed oscillatory force acting on the primary electromagnet 102. (Due to the magnitude of the forces involved and possible impact on the mechanical integrity of the coil, the primary electromagnet may be specifically designed to survive operation in the static magnetic field.) Similarly, the J×B interaction of the induced eddy current on the surface of the molten column of material with the static DC magnetic field results in a radially-directed oscillatory force acting on the surface of the liquid metal column. These two J×B forces are nearly equal in amplitude but oppositely directed. If the uniform static DC magnetic field shown schematically in FIG. 1 is denoted by $B_{dc}$, and the AC eddy current induced on the surface of the liquid metal column by the AC magnetic field is given by $J_{ac}(z)=(B_{ac}(z)/\mu)\sin(\omega t)$, then the resulting radially-directed J×B oscillatory pressure is given by $P_r(z)=J_{ac}(Z)\times B_{dc}=B_{dc}(B_{ac}(z)/\mu)\sin(\omega t)$, where $\omega=2\pi f$ and f is the operational frequency of the AC magnetic field coil. The result is an oscillatory bipolar pressure where the frequency is determined by the AC magnetic field, $B_{ac}(z)$, but the amplitude is independently determined by the strength of the static DC magnetic field, $B_{dc}$. Note that since the time-averaged value of this oscillatory pressure is zero, it does not alter the radial pressure balance required to support the outer boundary of molten column, which is provided solely by the AC magnetic field.

Combining the above results, the radially-directed J×B pressures resulting from both the DC and AC magnetic field interactions with the induced AC eddy current on the surface of the liquid metal column are given by $P_r(z)=J_{ac}(z)\times(B_{dc}+B_{ac}(z))=B_{dc}(B_{ac}(z)/\mu)\sin(\omega t)-([B_{ac}(z)]^2/2\mu)+([B_{ac}(z)]^2/2\mu)\cos(2\omega t)$, where $J_{ac}(z)$, $B_{ac}(z)$, $B_{dc}$, and $\omega$ have all been defined previously above. As already noted, the first term represents the oscillatory electromagnetic pressure resulting from the interaction of the induced surface current with the static DC magnetic field, the second term represents the inward directed gradient electromagnetic pressure designed to support the molten column, which is due solely to the AC magnetic field, and the third term is an oscillatory electromagnetic pressure at twice the frequency of the AC magnetic field, which is small compared to the first term whenever $B_{dc}>>B_{ac}$.

If, for example, the material to be processed is embedded in a uniform DC magnetic field of 10 Tesla and is used in conjunction with a confinement AC magnetic field of 0.1 Tesla, the induced acoustic pressure may have an amplitude of 4 bar (0.4 MPa) or 100 times larger than the acoustic excitation inherently provided by the confining AC magnetic field alone (albeit the latter is at twice the frequency). For other values of the DC magnetic field, the amplitude of the induced acoustic pressure varies linearly with the strength of the DC magnetic field. Acoustic pressure fields of this magnitude can provide the conditions beneficial for the casting method described herein, as well as the required flexibility. As the strength of the DC magnetic field is varied from 1 to 20 Tesla, the amplitude of the acoustic pressure drive to the surface of the melt increases from 0.4 to 8 bar (i.e. from 0.04 to 0.8 MPa). In this manner, the amplitude of the acoustical excitation can be adjusted to match the requirements of a specific processing technique.

The effectiveness of the acoustic stimulation can be greatly enhanced if the electromagnetic frequency coincides with a natural resonant frequency of the casting. Because of the large mismatch in the acoustic impedance at a liquid-air interface, most of the acoustic energy can be trapped within the liquid metal, forming an acoustical resonator. If the frequency is chosen to match a natural resonant frequency of the melt column, depending on the density of the melt and the diameter of the column, etc., then the peak acoustic pressure in the resonator may be enhanced by a factor that is equal to the quality factor of the resonator. Quality factors for molten columns can extend up into the range of 10, or more, depending on the length of the column. In some instances, consideration of acoustical resonances can be advantageous.

If the axial location of the secondary electromagnet is not concentric with the primary electromagnet, then the Lorentz force varies with distance from the center region of the secondary electromagnet and results in both radially-directed oscillations due to the axial magnetic field component, as well as axially-directed oscillations due to the radial components of the DC magnetic field. If the axis of the AC coil is not perfectly aligned with the axis of the DC magnetic field coil, then the currents induced in the surface of the solidifying metal may experience a torque that tends to rotate the material into alignment.

Materials that may be processed using the above-described method and apparatus include electrically conductive materials that are responsive to the AC and DC fields described above. Any electrically conductive material with a conductivity suitable for electromagnetic levitation without incurring excessive power dissipation arising from levitation currents induced in the surface of the material may be used. For example, suitable materials may include metals, alloys, conductive polymers and semiconductors, as well as materials that are not inherently conductive but may be rendered conductive, such as polymers that include electrically conductive particles (e.g., chopped carbon fibers, graphene platelets, or ferromagnetic particles) of microscale or nanoscale sizes dispersed throughout the volume or at the surface of the material. Accordingly, suitable materials may contain one or more elements selected from the group consisting of: Al, Cr, Mn, Fe, Co, Cu, Zn, Ga, Si, Ge, Zr, Nb, Mo, Tc, Ru, Rh, Pd, Ag, Cd, In, Sn, Sb, Hf, Ta, W, Re, Os, Ir, Pt, Au, Hg, Tl, Pb, Bi, Po, V, C, La, Ce, Pr, Nd, Sm, Eu, Gd, Tb, Dy, Ho, Er, Th, Yb, Lu, and Y.

The particles that are injected into the molten mass may be microscale or nanoscale particles ranging in linear size from about 1 nm to tens of microns, where the linear size refers to a nominal diameter or length of the particles. The linear size may refer to a primary particle size or to an agglomerate size. Typically, the particles have a linear size of from about 1 nm to about 1 micron, or from about 10 nm to about 500 nm. The particles may be substantially spherical or they may be elongated with a length-to-width aspect ratio greater than 1, greater than 5, or greater than 10. The particles may be injected in the form of a dry powder or a liquid dispersion, where in the latter case the particles are dispersed in a solvent. The particles may be electrically conductive, semiconductive or nonconductive, and they may be organic or inorganic. For example, the particles may comprise one or more of the following: carbon or a carbide, an oxide, a boride, a silicide, a nitride, and/or a fluoride. The particles may further have a surface coating to promote wetting and incorporation into the molten (or semi-solid) mass, and/or to provide a better interface between the particles and the solidified matrix to improve cohesion/bonding in the final cast product.

The particles injected into the surface and/or bulk of the molten mass of material may be selected to be useful as structural or functional particles upon solidification of the molten mass. The resulting solidified material may be a composite (e.g., a metal matrix composite or a polymer matrix composite) comprising a uniform or gradient microstructure due to the particle injection during casting.

The method and apparatus described herein according to various embodiments may facilitate superior surface castings for continuously cast bar product, eliminate any possibility of undesirable mold-casting interactions, and enable the introduction of nanoparticle dispersions into the molten surface, thereby producing either uniform dispersion or gradient dispersion composites or nanocomposites. The particle impingement speed and volume fraction, along with dwell time in the high magnetic field during solidification, may enable either gradient dispersion microstructures or uniform dispersion microstructures, depending on the final application requirements.

Examples of possible advantages of the above-described technology include: (a) Magnetic-field-enhanced alloy solute solubilities leading to new precipitation hardened alloys with accelerated kinetics and superior performance; (b) Next-generation nanoparticle-reinforced metal matrix composites for higher strength and higher creep temperature applications; (c) Rare-earth-, yttria-, and silver-free aluminum alloys with enhanced creep resistance comparable to alloys containing these additions, and similar benefits are anticipated for magnesium alloys; (d) High-specific strength, enhanced creep performance nanoparticle- and/or nanoprecipitate-reinforced aluminum for electric power transmission applications, with a performance target for electrical conductivity approaching that of pure copper; (e) Rapid, low-cost production of single-crystal or near-perfect textured materials for semiconductor, automotive (e.g., turbocharger compressor) and aerospace (e.g., turbine blades) applications.

Although the present invention has been described in considerable detail with reference to certain embodiments thereof, other embodiments are possible without departing from the present invention. The spirit and scope of the appended claims should not be limited, therefore, to the description of the preferred embodiments contained herein. All embodiments that come within the meaning of the claims, either literally or by equivalence, are intended to be embraced therein.

Furthermore, the advantages described above are not necessarily the only advantages of the invention, and it is not necessarily expected that all of the described advantages will be achieved with every embodiment of the invention.

The invention claimed is:

1. A method of dispersing particles in a molten material in a mold-less casting process, the method comprising:

forming a molten mass of material unsupported by a mold or other solid body;

applying a gradient electromagnetic pressure and an oscillatory electromagnetic pressure to the molten mass, the gradient electromagnetic pressure being non-oscillatory and being varied over at least a portion of the molten mass;

injecting particles into a surface region of the molten mass as the gradient and oscillatory electromagnetic pressures are being applied, the gradient electromagnetic pressure constraining the molten mass of material to a predetermined shape while the oscillatory electromagnetic pressure promotes mixing of the particles in the surface region; and solidifying the molten mass of material after injecting and mixing the particles, thereby forming a particle-reinforced casting with enhanced surface and/or bulk properties.

2. The method of claim 1, wherein forming the molten mass of material comprises melting at least a portion of a continuous feed of solid material, the method being a continuous casting process.

3. The method of claim 1, wherein forming the molten mass of material comprises melting at least a portion of a sample of solid material, the method being a batch casting process.

4. The method of claim 1, wherein applying the gradient electromagnetic pressure and the oscillatory electromagnetic pressure to the molten mass comprises exposing the molten mass of material to an AC magnetic field and to a DC magnetic field.

5. The method of claim 4, wherein the AC magnetic field comprises a field strength of from about 0.01 Tesla to about 0.5 Tesla and a frequency of from about 0.05 kHz to about 10,000 kHz, and wherein the DC magnetic field comprises a field strength of from about 1 Tesla to about 30 Tesla.

6. The method of claim 1, wherein the gradient electromagnetic pressure is expressed mathematically as $-[B_{ac}(z)]^2/2\mu$, where $\mu$ is the permeability in free space and $B_{ac}(z)$ is field strength of the AC magnetic field, and wherein the oscillatory electromagnetic pressure is expressed mathematically as $B_{dc}(B_{ac}(z)/\mu)\sin(\omega t)+([B_{ac}(z)]^2/2\mu)\cos(2\omega t)$, where p is permeability in free space, $B_{ac}(z)$ is field strength of the AC magnetic field, $B_{dc}(z)$ is field strength of the DC magnetic field, t is time, and $\omega=2\pi f$, where f is frequency of the AC magnetic field.

7. The method of claim 1, wherein injecting particles into a surface region of the molten mass comprises spraying the particles from one or more nozzles positioned about and oriented toward the molten mass.

8. The method of claim 1, wherein solidifying the molten mass comprises cooling the molten mass with a flow of a cooling fluid.

9. The method of claim 1, wherein the particle-reinforced casting comprises a non-uniform dispersion of the particles, a surface of the particle-reinforced casting comprising a higher volume fraction of the particles than a bulk of the particle-reinforced casting.

10. The method of claim 1, wherein the particle-reinforced casting comprises a substantially uniform dispersion of the particles throughout an entire cross-section thereof.

11. A method of dispersing particles in a molten material in a mold-less casting process, the method comprising:

forming a molten mass of material unsupported by a mold or other solid body, the material including a plurality of particles dispersed therein;

applying a gradient electromagnetic pressure and an oscillatory electromagnetic pressure to the molten mass of material, the gradient electromagnetic pressure being non-oscillatory and being varied over at least a portion of the molten mass, thereby constraining the molten mass of material to a predetermined shape while the oscillatory electromagnetic pressure promotes mixing of the particles in the molten mass; and solidifying the molten mass of material, thereby forming a particle-reinforced casting with enhanced surface and/or bulk properties.

12. The method of claim 11, further comprising injecting particles into a surface region of the molten mass as the gradient and oscillatory electromagnetic pressures are being applied.

13. The method of claim 11, wherein applying the gradient electromagnetic pressure and the oscillatory electromagnetic pressure to the molten mass comprises exposing the molten mass of material to an AC magnetic field and to a DC magnetic field.

* * * * *